US006406386B1

(12) United States Patent
Brazzell

(10) Patent No.: US 6,406,386 B1
(45) Date of Patent: Jun. 18, 2002

(54) BALL SIZE ADJUSTMENT MECHANISM FOR TABLE TENNIS ROBOT

(75) Inventor: James V. Brazzell, Gallatin, TN (US)

(73) Assignee: Newgy Industries, Inc., Gallatin, TN (US)

( * ) Notice: Subject to any disclaimer, the term of this patent is extended or adjusted under 35 U.S.C. 154(b) by 0 days.

(21) Appl. No.: 09/602,360

(22) Filed: Jun. 22, 2000

(51) Int. Cl.[7] ..... A63B 69/00

(52) U.S. Cl. ..... 473/431; 473/436; 473/475; 124/78; 124/81

(58) Field of Search ..... 124/6, 56, 78, 124/49; 473/436, 431, 422, 496, FOR 103, FOR 113, FOR 139

(56) References Cited

U.S. PATENT DOCUMENTS

| | | | | |
|---|---|---|---|---|
| 2,087,575 A | | 7/1937 | Littell et al. | |
| 2,199,009 A | | 4/1940 | Perryman | |
| 2,508,461 A | | 5/1950 | Lemon | |
| 2,765,171 A | | 10/1956 | Cook | |
| 2,793,636 A | | 5/1957 | Cook | |
| 3,043,592 A | | 7/1962 | Lohr | |
| 3,713,658 A | | 1/1973 | Cook | |
| 3,761,085 A | | 9/1973 | Cook | |
| 3,794,011 A | | 2/1974 | Newgarden, Jr. | |
| 3,878,827 A | | 4/1975 | Newgarden, Jr. | |
| 3,911,888 A | | 10/1975 | Horvath | |
| 3,917,265 A | | 11/1975 | Schrier et al. | |
| 4,002,336 A | | 1/1977 | Beaver et al. | |
| 4,046,131 A | | 9/1977 | Clark et al. | |
| 4,116,438 A | | 9/1978 | Berliner | |
| 4,185,824 A | | 1/1980 | Natwick | |
| RE30,703 E | | 8/1981 | Paulson et al. | |
| 4,559,918 A | | 12/1985 | Ballerin et al. | |
| 4,735,405 A | | 4/1988 | Marocco | |
| 4,760,835 A | * | 8/1988 | Paulson et al. | 124/76 |
| 4,844,458 A | | 7/1989 | Gatchel et al. | |
| 4,854,588 A | | 8/1989 | Gatchel et al. | |
| 4,917,380 A | | 4/1990 | Gatchel et al. | |
| 4,997,185 A | | 3/1991 | Bartasius | |
| 5,009,421 A | | 4/1991 | Gatchel et al. | |
| 5,012,790 A | * | 5/1991 | Bates | 124/6 |
| 5,257,615 A | * | 11/1993 | Jones | 124/49 |
| 5,335,905 A | | 8/1994 | Newgarden, Jr. | |
| 5,383,658 A | | 1/1995 | Newgarden, Jr. | |
| 5,485,995 A | | 1/1996 | Newgarden, Jr. | |
| 5,496,025 A | * | 3/1996 | Phillips et al. | 124/56 |
| 5,566,936 A | | 10/1996 | Newgarden et al. | |
| 5,771,621 A | * | 6/1998 | Rogers | 124/56 |
| 5,826,568 A | * | 10/1998 | Van Ross, Jr. | 124/6 |
| 6,093,117 A | * | 7/2000 | Sherlock et al. | 124/78 |

FOREIGN PATENT DOCUMENTS

| | | |
|---|---|---|
| DE | 12532236 | 3/1976 |

* cited by examiner

*Primary Examiner*—Paul T. Sewell
*Assistant Examiner*—Mitra Aryanpour
(74) *Attorney, Agent, or Firm*—Polster, Leider, Woodruff & Lucchesi, L.C.

(57) ABSTRACT

An automatic table tennis ball serving device is disclosed as having a generally vertically extending enclosure with a table tennis ball feeding passageway including a lower ball entrance and an upper ball dispensing outlet. Ball feeding arms are mounted to the enclosure adjacent the lower ball entrance for feeding table tennis balls upwardly in the ball feeding passageway against the force of gravity. A ball dispensing head is mounted to the enclosure adjacent the upper ball dispensing outlet for serving table tennis balls to a player at selected rates and trajectories. The ball dispensing head includes a ball size adjustment mechanism to enable table tennis balls of at least two diameters to selectively pass through the ball dispensing head when one or another diameter of the at least two different ball diameters is selected by the player.

12 Claims, 5 Drawing Sheets

BALL SIZE ADJUSTMENT MECHANISM FOR TABLE TENNIS ROBOT

CROSS REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

The present invention relates to a table tennis ball size adjustment mechanism for use in conjunction with table tennis robots or devices that automatically serve table tennis balls at varying rates and trajectories to a player.

In order to improve the skill, dexterity and accuracy of table tennis players, table tennis robots have been developed. These devices sequentially collect and then feed a plurality of table tennis balls upwardly within an enclosure to a serving head which serves table tennis balls to a player at varying rates and trajectories as determined by the player. For example, attention is directed to the following patents (U.S. Pat. Nos. 4,844,458; 5,009,421; 5,335,905; 5,383,658; 5,485,995) as examples of various types of table tennis robots that are used by themselves or in conjunction with troughs and/or netting to facilitate collection of the table tennis balls.

It has been determined by the International Table Tennis Federation that it is difficult to watch and enjoy table tennis matches on television due to the speed of the game. One simple way of slowing down the game is to increase ball size. It has, therefore, been determined by the International Table Tennis Federation that table tennis matches should be slowed down by increasing the size of the table tennis balls. Changing the diameter of the table tennis ball from 38 mm to 40 mm is enough of a change to enable users to effectively watch and enjoy table this matches, without otherwise affecting the game. Therefore, the International Table Tennis Federation has mandated that ball size for table tennis matches be changed from 38 mm to 40 mm. While this will facilitate television enjoyment of table tennis matches, it will not necessarily replace or supplant 38 mm table tennis balls where players may find sport in playing a faster game or where players practice with 38 mm table tennis balls for table tennis matches using 40 mm balls.

For the reasons set forth above, table tennis robots must be adaptable to be used with either 38 mm or 40 mm table tennis balls, and according to the present invention as discussed in detail below, a unique and practical solution has been discovered to enable table tennis robots to be used with different ball sizes as may be selected by the player.

BRIEF SUMMARY OF THE INVENTION

Among the several objects and advantages of the present invention are the following:

The provision of a table tennis serving device or robot having the capability of use with different ball sizes;

The provision of the aforementioned device or robot which can be simply and quickly converted for use with at least two different ball sizes;

The provision of the aforementioned device or robot which includes a ball size adjustment mechanism to enable use with different sized balls;

The provision of the aforementioned device or robot which includes a manually adjustable ball size adjustment mechanism; and The provision of the aforementioned device or robot which engages and moves the ball size adjustment mechanism between different ball size operating positions.

Briefly stated, the automatic table tennis ball serving device includes a generally vertically extending enclosure having a table tennis ball passageway extending from a lower ball entrance to an upper ball dispensing outlet for receiving a plurality of table tennis balls. Ball feeding arms are mounted to the enclosure adjacent the lower ball entrance for feeding table tennis balls upwardly in the ball feeding passageway against the force of gravity. A ball dispensing head is mounted to the enclosure adjacent the upper ball dispensing outlet for serving table tennis balls to a player at selected rates and trajectories. The ball dispensing head includes a ball size adjustment mechanism to enable table tennis balls of at least two diameters to pass through the ball dispensing head when one or another diameter of the at least two diameters is selected by the player.

Typically, the ball size adjustment mechanism is moved between two operating positions and is manually operable. Such movement is also preferably accomplished by a slidable mounting on the enclosure for engaging a spring loaded ball support in the ball serving head. The spring loaded ball support is spring loaded relative to a driven ball serving wheel in the ball serving head.

These and other objects and advantages will become apparent from the description that follows.

BRIEF DESCRIPTION OF THE SEVERAL VIEWS OF THE DRAWINGS

The objects of the invention are achieved as set forth in the illustrative embodiments shown in the drawings which form a part of the specification.

In the drawings.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
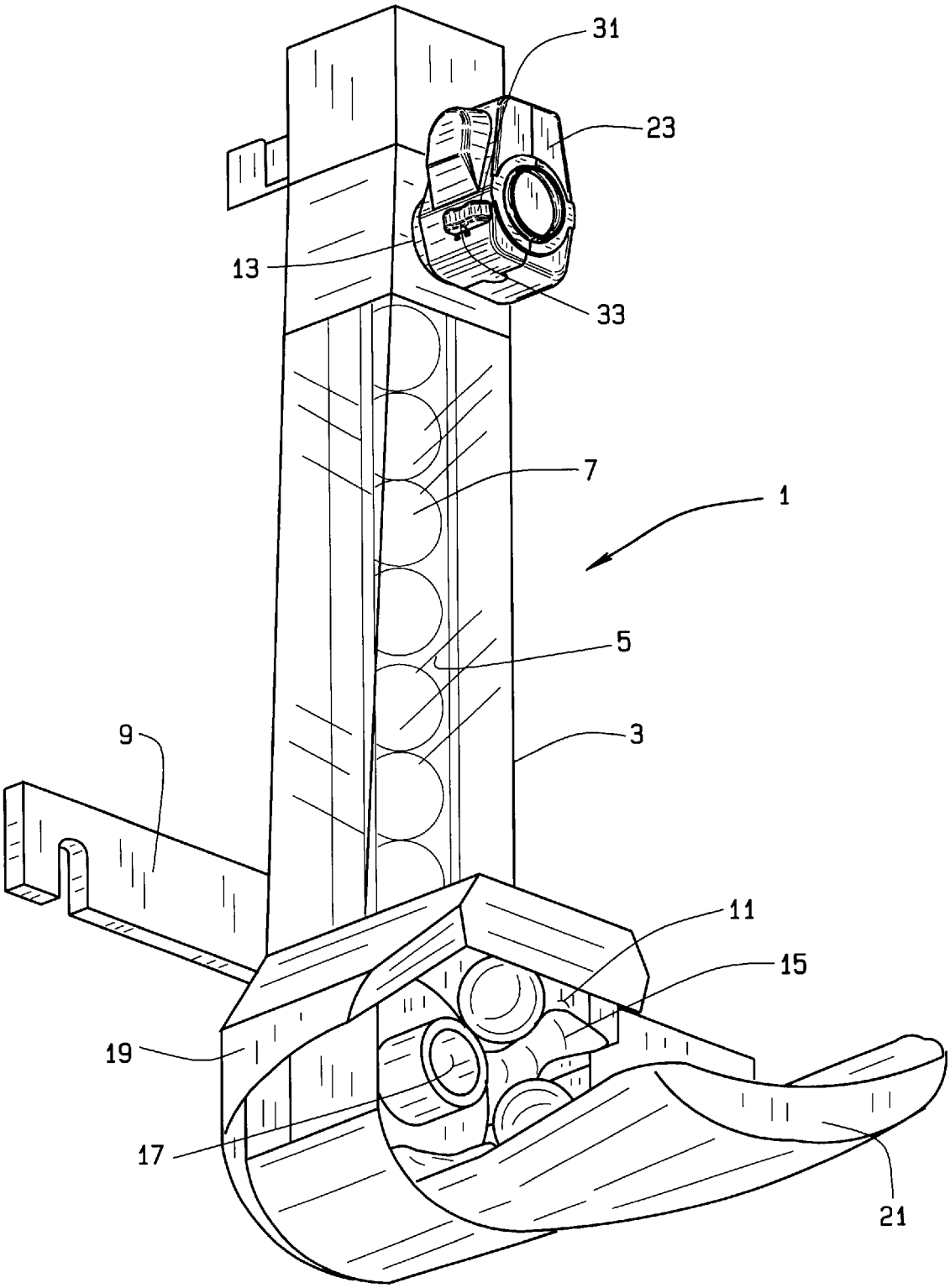
FIG. 1 is a perspective view of a table tennis ball serving device that incorporates a ball size adjustment mechanism constructed in accordance with the teachings of the present invention.

An automatic table tennis ball serving device or table tennis robot 1 is shown in FIG. 1 of the drawings as including an enclosure 3 having a table tennis ball passageway 5 for receiving table tennis balls 7. The enclosure 3 receives table tennis balls 7. The enclosure 3 is connected to a horizontal support arm 9 for attaching the table tennis robot 1 in an upright position to a table tennis table (not shown), as illustrated, for example, in U.S. Pat. No. 4,844,458 and other patents referred to above. Thus, the enclosure 3 is mounted to the table tennis table (not shown) in a generally vertically extending position. This enables the ball feeding passageway 5 to feed balls from a lower ball entrance 11 to an upper ball dispensing outlet 13.

Ball feeding arms 15 are rotatably mounted to the enclosure 3 adjacent the lower ball entrance 11. The ball feeding arms 15 are mounted on a shaft 17 that is driven by a motor (not shown) for feeding the table tennis balls 7 upwardly in the ball feeding passageway 5 against the force of gravity. The ball feeding arms 15 are received within a housing 19 at the lower end of the enclosure 3, the housing 19 including a ball scoop or trough 21 for collecting and positioning table tennis balls 7 relative to the ball feeding arms 15, as is well known.

Figure 12:
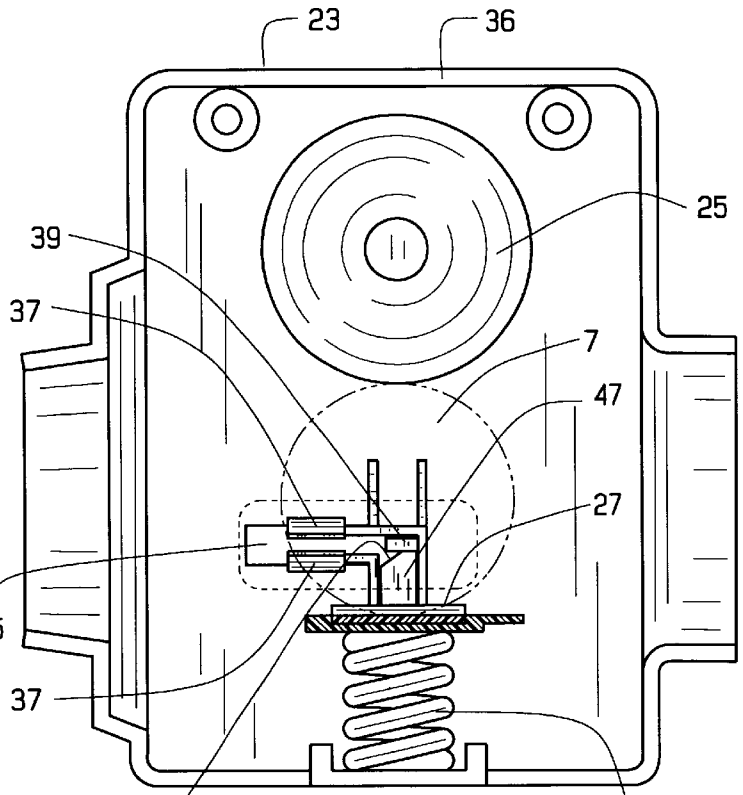
FIG. 12 is a side elevational view of one-half of the ball serving head with the movable sliding clement in the ball size position of FIG. 10.
Figure 11:
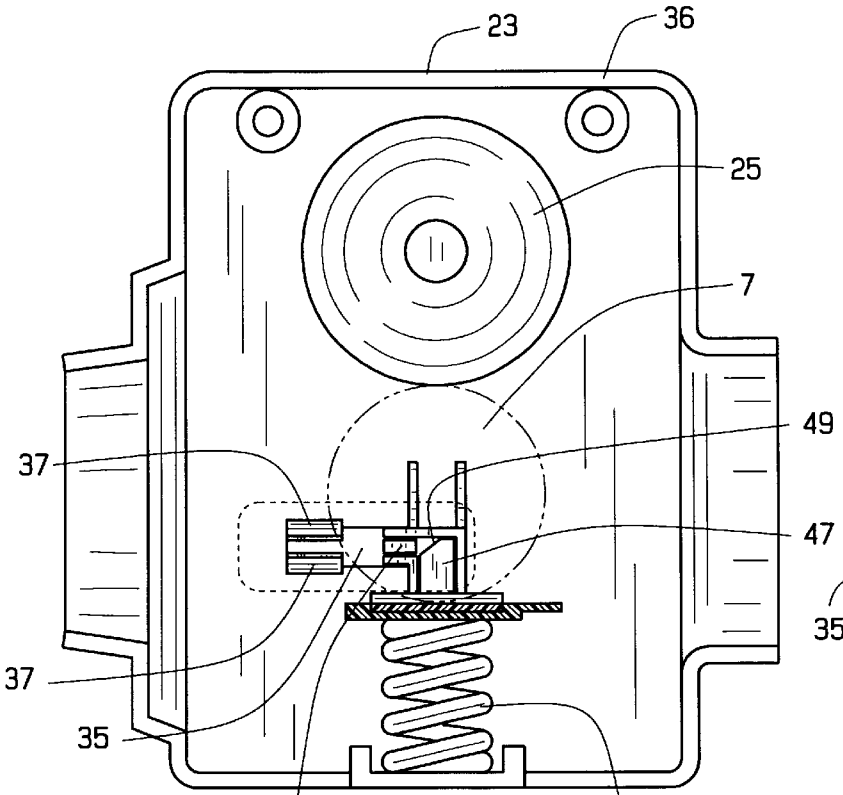
FIG. 11 is a side elevational view of one-half of the ball serving head with the movable sliding element in the ball size position of FIG. 9.
Figure 13:
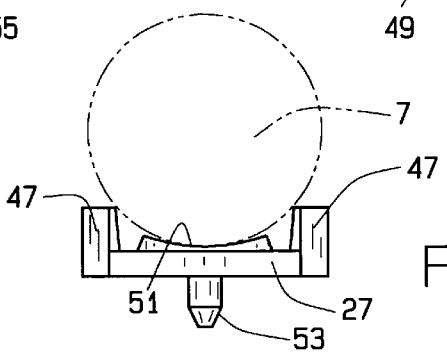
FIG. 13 is a side elevational view of the ball support used with the ball size adjustment mechanism of the present invention.

A ball dispensing head 23 is mounted to the enclosure 3 adjacent the upper ball dispensing outlet 13 for serving table tennis balls 7 to a player at selected rates and trajectories. For this purpose, a ball serving wheel 25 is shown in FIGS. 11–13 as being mounted in cooperating and opposed relationship to a ball support 27, as is commonly employed in the aforementioned patents, for serving the table tennis balls 7. The ball serving wheel 25 is driven by a motor (not shown) while the ball dispensing head 23 is driven by a different motor (not shown) in order to impart spin or english to the table tennis balls 7 as they leave the ball dispensing head 23. It will be appreciated that different rates or trajectories of spin or english can be imparted to the table tennis balls 7 depending upon which way the ball dispensing head 23 is positioned which, in turn, positions the ball serving wheel 25 in different positions relative to the ball support 27. All of this discussed in greater detail in the aforementioned patents.

The present invention is directed to improvements to the ball dispensing head 23 in order to enable table tennis balls of at least two diameters (i.e., 38 mm or 40 mm) to pass through the ball dispensing head 23 when a particular ball size is selected by a player.

Figure 2:
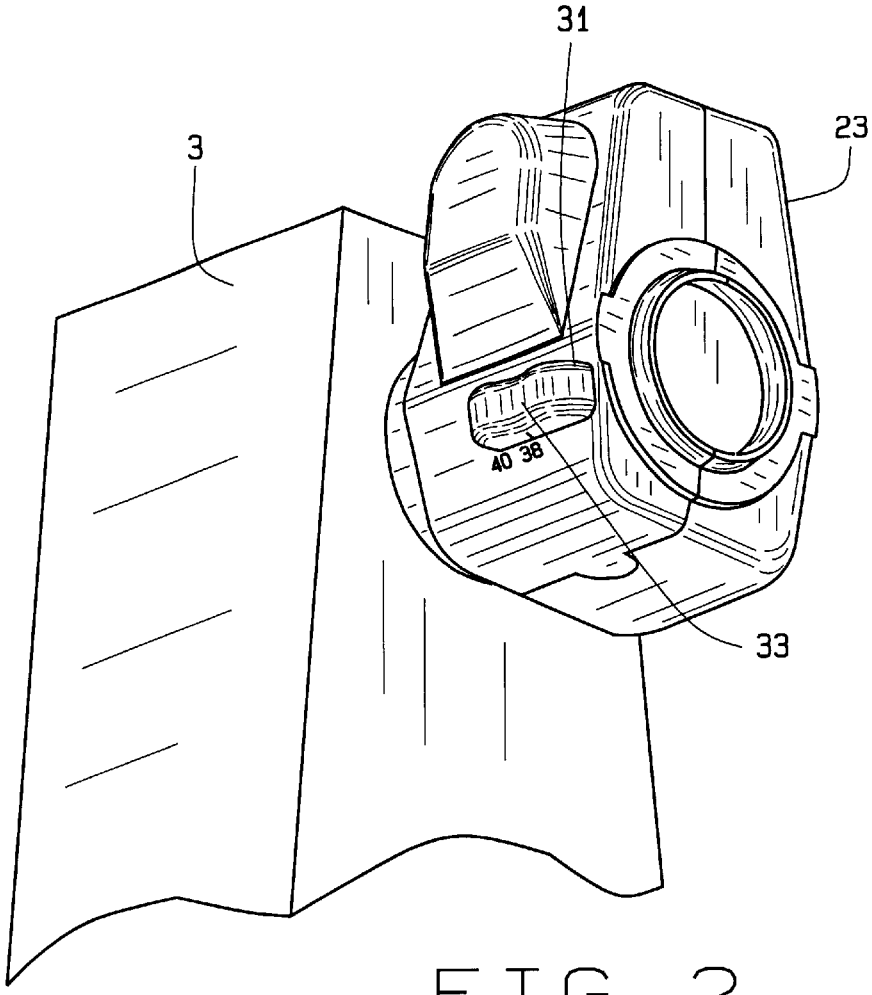
FIG. 2 is an enlarged fragmentary perspective view of the serving head with the ball size adjustment mechanism in one ball size position.
Figure 3:
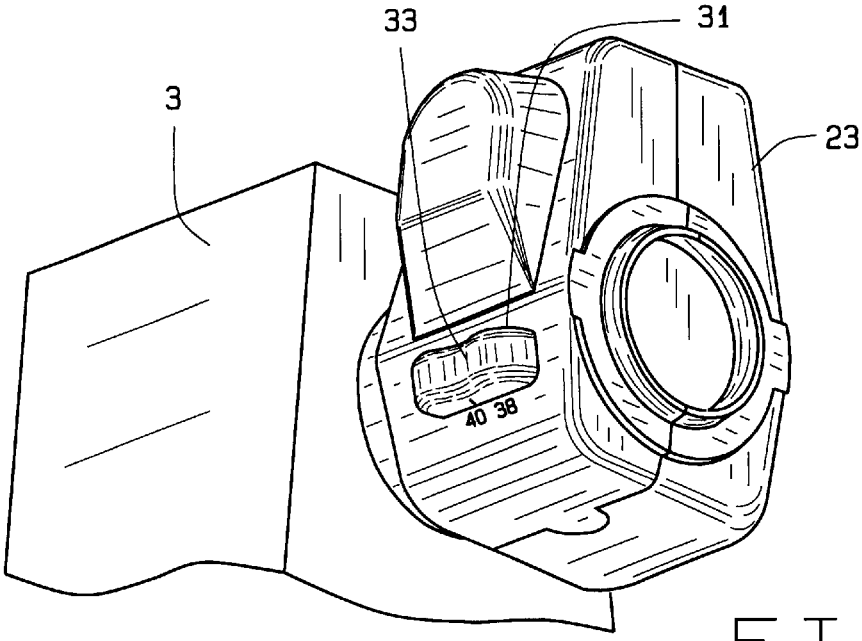
FIG. 3 is an enlarged fragmentary perspective view of the ball size adjustment mechanism in another ball size position.
Figure 4:
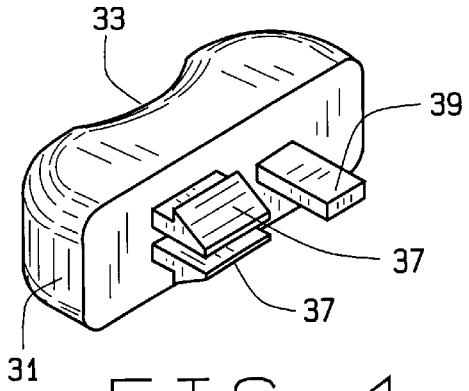
FIG. 4 is an enlarged perspective view of the movable sliding element of the ball size adjustment mechanism.
Figure 5:
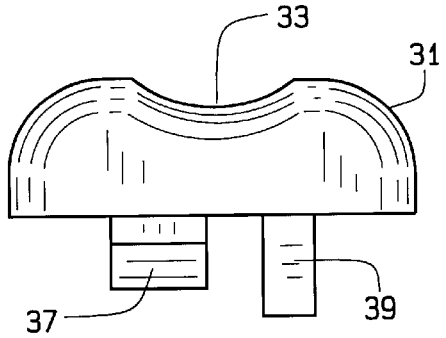
FIG. 5 is an enlarged size elevational view of the movable sliding element shown in FIG. 4.
Figure 6:
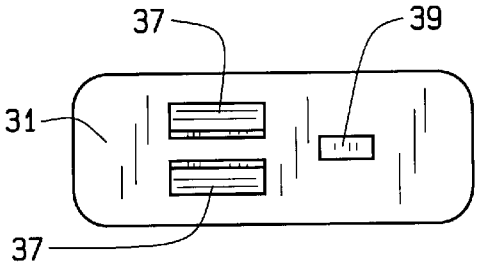
FIG. 6 is a bottom plan view of the movable sliding clement shown in FIG. 4.
Figure 7:
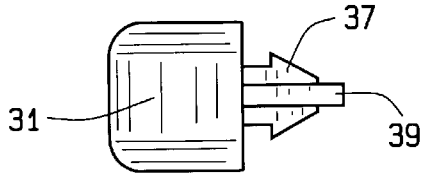
FIG. 7 is an end elevational view of the movable sliding element shown in FIG. 4.
Figure 8:
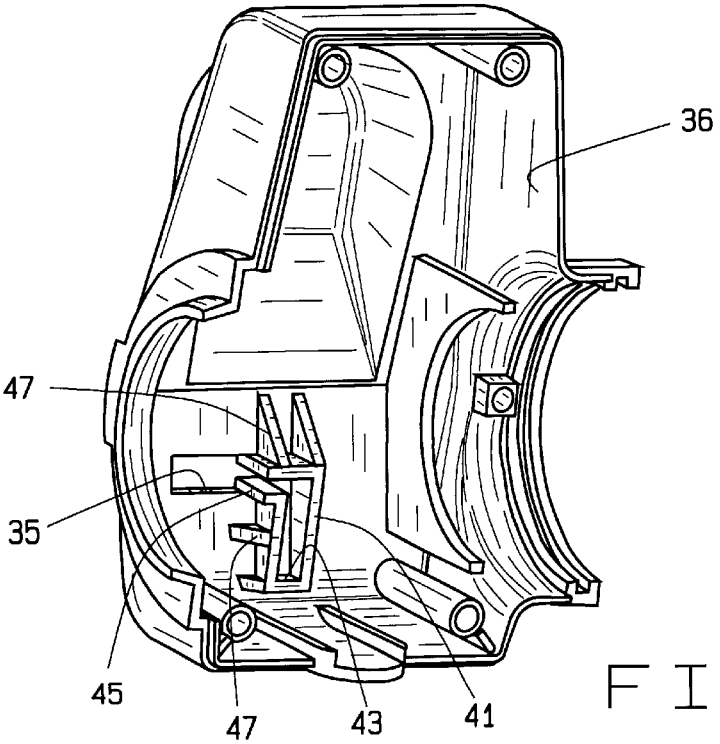
FIG. 8 is a perspective view of one-half of the ball serving head showing the inside construction thereof.
Figure 9:
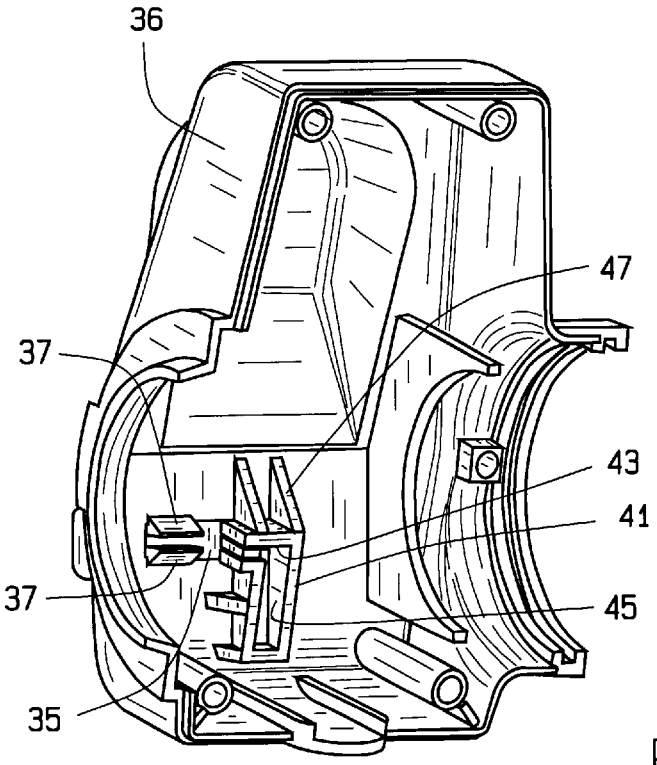
FIG. 9 is also a perspective view of one-half of the ball serving head with the movable sliding element in one ball size position.
Figure 10:
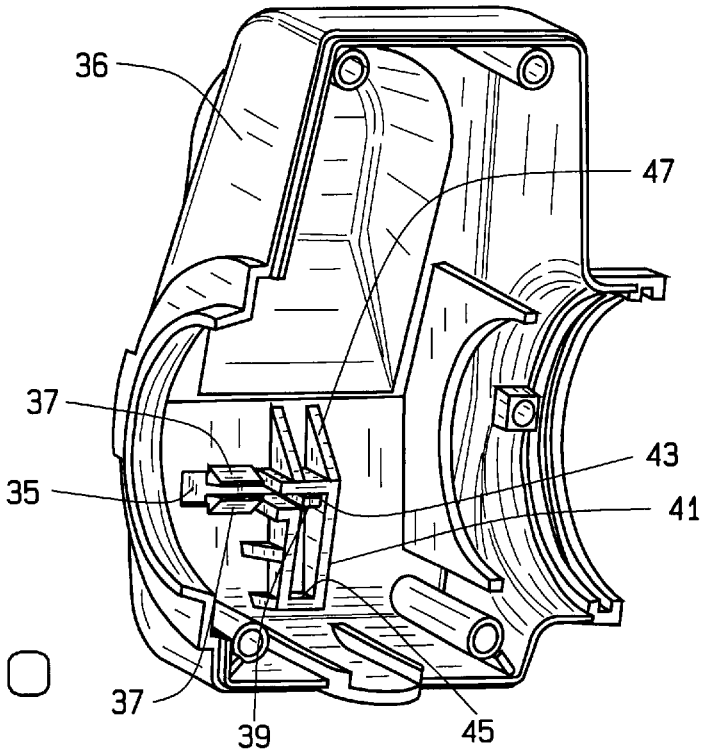
FIG. 10 is also a perspective view of one-half of the ball serving head with the movable sliding element in another ball size position.

In order to permit adjustment of the ball serving head 23 between 38 mm and 40 mm, it will be noted that the ball serving head 23 includes a pair of slide elements or arms 31 having an undulating outer contour 33 to enable the player to move the slide elements 31 between 38 mm and 40 mm operating positions as best seen in FIGS. 2–3 of the drawings. Each slide element 31 is received within a slot 35 formed in each half housing section 37 of the ball serving head 23 as shown in FIGS. 8–9 of the drawings. For reception within the slot 35 of each housing half section, the slide element 31, as best seen in FIGS. 4–7, includes spring biased and spaced hook shaped finger elements 37, 37 which are capable to being collapsed during insertion into the slot 35 and then spring back to engage marginal portions surrounding the slot 35 for holding each slide element 31 relative to its respective slot 35. Each slide element 31 further includes an inwardly extending camming finger 39 for engagement with the ball support 27 as will presently be described. As best seen in FIG. 8 of the drawings, each housing half section 37 includes an inwardly projecting molded section 41 including up-side down L-shaped slots 43, 45. The inwardly projecting molded section 41 is buttressed to each housing half section 37 by triangular struts 47 that extend around the inwardly projecting molded section 41. Each slot 43 of the inwardly projecting molded sections 41 intersects with each slot 35, in its respective housing half section 37, for receiving the camming finger 39 extending from each slide element 31, as best seen in FIGS. 8–9 of the drawings.

Each camming finger 39 of each slide element 31, when moved within the slot 43 and aligned with slot 45 engages the upwardly extending end members 47 of the ball support 27, as best seen in FIGS. 11–12. Each end member 47 includes a sloping face 49 for camming engagement with the camming finger 39 of a respective slide element. When this occurs, the ball support 27 is lowered in order to enable larger table tennis balls 7, i.e., 40 mm balls, to be served from the ball serving head 23. In this instance, the ball support 27 is lowered 2 mm to permit the larger 40 mm table tennis balls to be served in lieu of the 38 mm balls.

As also shown in FIGS. 13, the ball support 27 includes an upwardly concave shaped ball section 51 and a downwardly extending spring finger support 53 for receiving the coil spring 55, as shown in FIGS. 11–12.

Thus, the spring loaded ball support 27 is capable of movement downwardly 2 mm when the camming finger 39 of each slide element 31 engages its respective sloping face 49 of the ball support end members 47, 47. Movement of the slide element 31 back from the 40 mm to the 38 mm operating position causes camming disengagement of the aforementioned elements and enables the coil spring 55 to automatically return the ball support 27 to its 38 mm operating position. In this way, the improved table tennis robot 1 of the present invention allows either 38 mm or 40 mm table tennis balls 7 to be served from the ball serving head 23 by the simple manipulation of each slide element 31 provided in each housing half section 37. Additional dimensional adjustments within or outside this range can also be made, as will be appreciated.

From the foregoing, it will now be appreciated that the present invention provides a very simple, but extremely unique solution to the problem of accommodating table tennis robots for balls of 38 mm or 40 mm, when selected by the player. All of the other features of the table tennis robot 1, as disclosed in the aforementioned patents remain intact, as may be desired. Thus the improved table tennis robot 1 of the present invention affords greater flexibility with a broader range of ball sizes than units which lack this important feature.

In view of the above, it will be seen that the several objects and advantages of the present invention have been achieved and other advantageous results have been obtained.

What is claimed is:

1. An automatic table tennis ball serving device, comprising:

a generally vertically extending enclosure having a table tennis ball feeding passageway extending from a lower ball entrance to an upper ball dispensing outlet for receiving a plurality of table tennis balls;

ball feeding arms mounted to said enclosure adjacent the lower ball entrance for feeding table tennis balls upwardly in the ball feeding passageway against the force of gravity;

a ball dispensing head mounted to said enclosure adjacent the upper ball dispensing outlet for serving table tennis balls to a player at selected rates and trajectories; and the ball dispensing head including a ball size adjustment mechanism to enable tennis balls of at least two different diameters to pass through the ball dispensing head when one or another diameter of the at least two different ball diameters is selected by the player.

2. The device as defined in claim 1 in which the ball size adjustment mechanism is moved between two positions defining two different diameters of balls.

3. The device as defined in claim 2 in which the ball size adjustment mechanism is manually operable.

4. The device as defined in claim 1 in which the ball size adjustment mechanism is slidably mounted on the enclosure between two operating positions.

5. The device as defined in claim 4 in which the ball size adjustment mechanism includes a spring loaded ball support movable between the two operating positions.

6. The device as defined in claim 1 in which the ball size adjustment mechanism is slidably mounted on the enclosure for manual operation between two operating positions defining two different diameters of balls.

7. An automatic table tennis ball serving device, comprising:

a generally vertically extending enclosure having a ball feeding passageway extending from a lower ball entrance to an upper ball dispensing outlet for receiving a plurality of table tennis balls;

ball feeding arms mounted to said enclosure adjacent the lower ball entrance for feeding table tennis balls upwardly in the ball feeding passageway against the force of gravity;

a ball dispensing head mounted to said enclosure adjacent the upper ball dispensing outlet, the ball dispensing head including cooperating and opposed driven ball serving wheel and ball support for serving table tennis balls to a player at selected rates and trajectories; and the ball support being adjustable towards and away from the driven ball serving wheel to enable table tennis balls of at least two different diameters to be served by the ball dispensing head.

8. The device as defined in claim 7 in which the stationary ball support is spring loaded relative to the driven ball serving wheel.

9. The device as defined in claim 8 in which the stationary ball support is movable between ball size operating positions by a ball size adjustment slide mounted on the enclosure for movement between various balls size operating positions.

10. The device as defined in claim 9 in which the ball size adjustment slide includes a slide element that engages and moves the stationary ball support between ball size operating positions.

11. An automatic table tennis ball serving device, comprising:

a generally vertically extending enclosure having a ball feeding passageway extending from a lower ball entrance to an upper ball dispensing outlet for receiving a plurality of table tennis balls;

ball feeding arms mounted to said enclosure adjacent the lower ball entrance for feeding table tennis balls upwardly in the ball feeding passageway against the force of gravity; and a ball dispensing head mounted to said enclosure adjacent the upper ball dispensing outlet, the ball dispensing head including cooperating and opposed driven ball serving wheel and ball support for serving table tennis balls to a player at selected rates and trajectories, the ball support being spring loaded relative to the driven ball serving wheel and adjustable towards and away from the driven ball serving wheel to enable table tennis balls of at least two different diameters to be served by the ball dispensing head.

12. An automatic table tennis ball serving device, comprising:

a generally vertically extending enclosure having a table tennis ball feeding passageway extending from a lower ball entrance to an upper ball dispensing outlet for receiving a plurality of table tennis balls;

ball feeding arms mounted to said enclosure adjacent the lower ball entrance for feeding table tennis balls upwardly in the ball feeding passageway against the force of gravity; and a ball dispensing head mounted to said enclosure adjacent the upper ball dispensing outlet for serving table tennis balls to a player at selected rates and trajectories, the ball dispensing head including a ball size adjustment mechanism slidably mounted on the enclosure between two operating positions with a spring loaded ball support movable between the two operating positions to enable tennis balls of at least two different diameters to pass through the ball dispensing head when one or another diameter of the at least two different ball diameters is selected by the player.

* * * * *